United States Patent [19]

Kageyama et al.

[11] 4,171,170

[45] Oct. 16, 1979

[54] AUTOMATIC PENCIL

[75] Inventors: Hidehei Kageyama; Takahiko Suzuki, both of Kawagoe, Japan

[73] Assignee: Kotobuki & Co., Ltd., Kyoto, Japan

[21] Appl. No.: 805,152

[22] Filed: Jun. 9, 1977

[30] Foreign Application Priority Data

Mar. 31, 1977 [JP] Japan ..... 52-40465
Apr. 2, 1977 [JP] Japan ..... 52-41492

[51] Int. Cl.[2] ..... B43K 21/22
[52] U.S. Cl. ..... 401/65; 401/54
[58] Field of Search ..... 401/54, 65

[56] References Cited

U.S. PATENT DOCUMENTS

| | | | |
|---|---|---|---|
| 3,804,536 | 4/1974 | Torii et al. | 401/65 |
| 3,813,175 | 5/1974 | Katz | 401/65 |
| 3,880,530 | 4/1975 | Katz | 401/65 |
| 3,899,256 | 8/1975 | Mitsuya | 401/65 |
| 3,947,133 | 3/1976 | Kageyama | 401/65 |
| 4,015,269 | 3/1977 | Edo | 401/65 |

*Primary Examiner*—William Pieprz
*Attorney, Agent, or Firm*—Sherman & Shalloway

[57] ABSTRACT

An automatic pencil employing axial movement of a lead piece guide and a lead piece chucking mechanism. After a length of protruding lead rod is used up, the lead piece guide is caused to retract in the same amount as the wearing away of the lead rod. By pressing the tip of the lead rod against another object, the lead rod is caused to move back with the chucking mechanism. After the rod is retracted until the tip aligns with the tip of the guide, the rod and lead piece guide will be moved back. The rod will then advance when the holder is moved away from the object while the lead piece guide will be left in the retracted position due to a large friction between the friction member and the guide means. By this operation, the rod is protruded from the guide at substantially equal length to the stroke of the retracting movement. In other words, the guide is moved back at each time when the rod moves back and forward to allow the rod to protrude by a constant length which is irrespective to that which has previously protruded.

4 Claims, 2 Drawing Figures

AUTOMATIC PENCIL

FIELD OF THE INVENTION

This invention relates to a knock-type automatic pencil and, more particularly, it is concerned with an improved automatic pencil in which the writing is started with a predetermined length of lead projecting from a tubular lead piece guide. As the projected portion of the lead piece is worn away, the need for a lead piece is automatically projected from the tip end of the lead piece guide without the lead piece stepping operation by means of, for example, a knock-button or the like. Further in the case where, an excessive pressure (writing pressure) is imposed on the lead, the lead resiliently moves backward, to prevent breaking of the lead piece.

PRIOR ART

Heretofore, when writing is carried out with an automatic pencil, the length of the lead piece projected from the tip end of the lead piece guide (projected length) has been limited to a definite length. There has been a need for extending the lead piece to a required length from the forward end of the lead piece guide by a lead piece stepping means. The lead piece stepping means of automatic pencils can be accomplished, for example, by knocking a push-button provided at the rear end of the outer tube. However, this lead piece stepping operation can be carried out only when the writing operation is stopped, resulting in poor writing efficiency. Furthermore, there is a risk that the lead piece may be broken when an excessive pressure is imposed on the lead piece.

SUMMARY OF THE INVENTION

It is an object of the present invention to provide an automatic pencil wherein the above problems can be solved.

Another object of the present invention is to provide an automatic pencil wherein a lead piece is automatically projected from the forward end of the lead piece guide according to the wearing away of the lead piece, whereby there is no necessity of projecting the lead piece while writing.

Still further object of the present invention is to provide an automatic pencil wherein, when an excessive pressure is imposed on a lead piece the lead piece itself moves backward with a predetermined resiliency, thereby preventing breakage of the lead piece.

Further objects and features of the present invention will be more apparent from the following description referring to the accompanying drawings.

PREFERRED EMBODIMENT OF THE INVENTION

Figure 1:
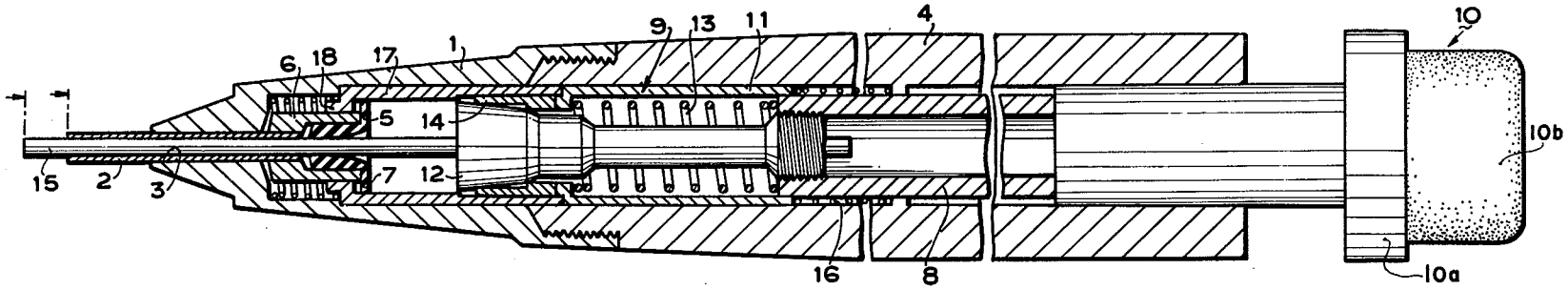
FIG. 1 is a longitudinal sectional view of an automatic pencil of an embodiment according to the present invention.

Referring now to FIG. 1, reference numeral 1 designates a guide means having a bore 3 at the center thereof for inserting a lead piece guide 2 thereinto. This guide means 1 is detachably fixed to the forward end of an outer tube 4 to be held by the user by means of, for example, a screw.

Into the bore 3 of the guide means 1 is inserted a guide 2 for guiding the lead piece, which is slidable in the axial direction and is held with the forward end projecting from the guide means 1 at a predetermined length. As the rear end of said lead piece guide 2 a tubular member 6 is force fitted with a friction member 5. The friction member 5 may be made of, for instance, rubber, and has a circular flange 7 at one end thereof.

Reference numeral 8 denotes an inner tube for receiving lead pieces therein and this inner tube 8 is axially, slidably received in the outer tube 4. The inner tube 8 is provided, at the forward end thereof, with a lead piece chucking mechanism 9 and at the rear end thereof, with a knocking portion 10 consisting of a knock-button **10*a* and an eraser 10*b*. Reference numeral 11 denotes a sleeve loosely mounted on a chucking pawl 12. In the sleeve 11 is loosely mounted a spring 13 adapted to urge a chucking ring 14 so as to hold the lead piece 15 as shown in the drawing. Reference numeral 16 illustrates a spring adapted to urge the lead piece chucking mechanism 9 forward and, at the same time, to resiliently retract the lead piece 15 inward when an excessive writing pressure is imposed on the lead piece 15**, thereby to eliminate the breaking of the lead piece.

Reference numeral 17 is a sleeve provided in the guide means 1, with one end thereof in contact with the forward end of the sleeve 11 so as to fit the front end of the lead piece chucking mechanism 9, and with the other open end thereof facing the tubular member 6 provided at the rear end of the lead piece guide 2. In the sleeve 17 is included a flange portion 7 of the friction member 5 with a predetermined frictional pressure and its movement is regulated between the front flange 18 of the sleeve 17 and the front surface of the chucking pawl 12. More specifically, during writing the friction member 5 holds the lead piece guide 2 in a state where the lead piece 15 is projected in a predetermined length from the lead piece guide 2, on which no writing pressure is imposed. Breaking of the lead piece in a writing state is prevented by the buffer action of the spring 16. However, in the case where writing is carried out with a lead piece projecting from the lead piece guide 2 in an extremely short length on purpose or due to wear, the writing pressure is exerted on the lead piece guide 2 itself. The friction member 5 provided in the sleeve 17 slides backward gradually according to the writing pressure exerted thereon up to a point where the backward sliding of the friction member 5 is prevented by its abutting against the chucking pawl 12 so that the lead piece guide 2 can be drawn back into the guide means 1. In this case, the backward movement of the friction member 5 is equal to the wearing length of lead piece whereby the lead piece 15 in the course of writing is always stably held by the lead piece guide 2, and the breaking of the lead piece in this writing state can be eliminated in almost all cases.

Incidentally, the friction member thus backward returns to its original position by taking advantage of the forward movement of the chucking pawl 12 when knocked.

Figure 2:
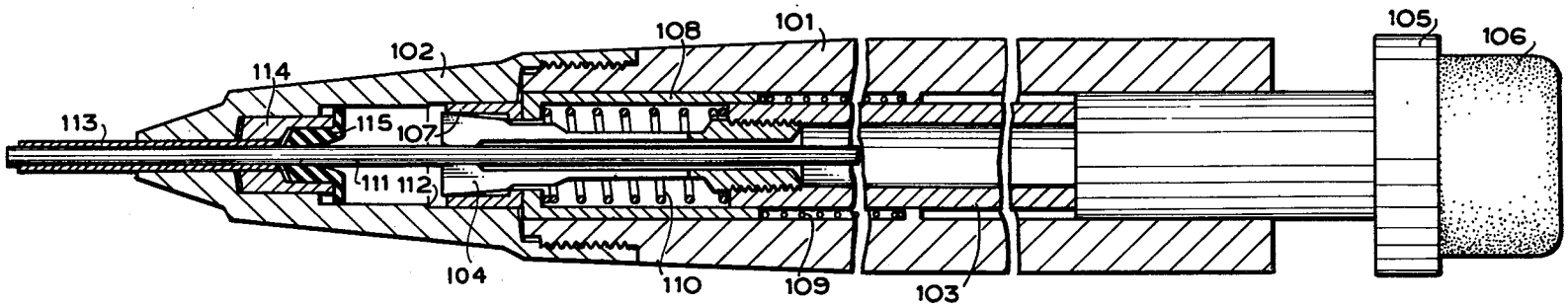
FIG. 2 is a longitudinal, partly cut away, sectional view of an automatic pencil of another embodiment of the present invention.

FIG. 2 illustrates another embodiment of an automatic pencil according to the present invention, in which reference numeral 101 designates an outer tube, 102 a guide means provided at the forward end of the outer tube 101, 103 an inner tube coaxially inserted into the outer tube 101, 104 a lead piece chuck mounted at the forward end of the inner tube 103, and 105 a knock-button detachably provided at the rear end of the inner tube 103, the knock-button being provided with an eraser 106 at the rear end thereof, if necessary. The forward end of the lead piece chuck 104 passes through the central bore of a chucking ring 107, and the rear end of the chucking ring 107 abuts the forward end of a sleeve 108 which is movable in the axial direction in the outer tube 101. This sleeve 108 is urged toward the foremost end of its movable range by a spring 109 provided between the outer tube 101 and the sleeve 108, while the inner tube 103 is urged backward by a spring 110 provided between the sleeve 108 and the inner tube 103.

When no external force is exerted, the sleeve 108 is held at the forward end (the position shown in the drawing) in its movable range, while the lead piece chuck 104 fixed to the inner tube 103 (urged backward) moves backward relative to the chucking ring 107, whereby the lead piece chuck 104 at its forward end clamps the lead piece 111 passing through the central bore thereof. In this state, when the knock-button 105 is pushed, the inner tube 103 and the lead piece chuck 104 move forward together with the chucking ring 107 engaging the chuck 104 at the forward end. After the chucking ring 107 reaches a retracted position 112 formed in the guide means 102, the lead piece chuck 104 moves forward relative to the chucking ring 107 so as to release the clamping of the lead piece 111. Further, when the knock-button is released, the inner tube 103 and the lead piece chuck 104 move backward and when the chucking ring 107 abuts the sleeve 108 and clamps the forward end of the lead piece chuck 104, the inner tube 103 and the sleeve 108 stop. Repetition of this operation causes the lead piece 111 to extend forward. The length of the lead piece extended forward by one lead piece stepping operation is practially equal to that from the forward end of the chucking ring 107 to the stage portion 112.

Further, in the guide means 102 is inserted a tubular lead piece guide 113 movable in the axial direction relative to the guide means 102, through which a lead piece 111 passes. To the rear end of the lead piece guide 113 are fixed a tubular member 114 and a friction member 115. The tubular member 114 is adapted to regulate the foremost end in the movable range of the lead piece guide 113 and the friction member 115 imparts a proper frictional resistance to the relative movements between the lead piece guide 113 and the lead piece 111 and the lead piece guide 113 and the guide means 102.

In the course of moving the lead piece forward by a lead piece stepping operation of the automatic pencil having a structure as described above, the frictional resistance between the lead piece 111 and the friction member 115 is smaller than that between the friction member 115 and the guide means 102, thereby to move the lead piece 111 forward relative to the lead piece guide 113. Thus, when the lead piece 111 is projected from the forward end of the lead piece guide 113 in proper length, the automatic pencil can be used as an ordinary automatic pencil. In the course of writing, if the lead piece 111 becomes short in its projected length due to wear or breakage, the tip end of the lead piece 111 is pressed against the paper sheet or the like while the outer tube 101 is being held in the hand. By this operation, a backward pressing force is exerted on the lead piece chuck 104 holding the lead piece 111 and the inner tube 103 integrally moving therewith, whereby said lead piece chuck 104 and inner tube 103 retract together with the chucking ring 107 and the sleeve 108 against the spring force of the spring 109. Incidentally, the movable backward range of said members is set to be a length of the order of 0.5 to 1.0 mm. In the course of backward movement of the lead piece 111, after the tip end of the lead piece 111 retracts to the forward end of the lead piece guide 113, the lead piece guide 113 itself is also pressed against the paper sheet or the like, whereby the lead piece guide 113 retracts together with the tubular member 114 and the friction member 115. When the lead piece 111 retracts to the last stage of its movable range, the positions of the lead piece 111 and the lead piece guide 113 coincide with each other. When the pressing force generated by pressing the outer tube 101 against the paper sheet or the like is removed, the sleeve 108 returns to the foremost end in its movable range by the restoration force of the spring 109, whereby chucking ring 107 moves forward together with the lead piece chuck 104 and the lead piece 111 held thereby to return where they were. However, the lead piece guide 113 does not move forward due to a large frictional resistance between the friction member 115 and the guide means 102. Thus, the lead piece 111 is projected from the forward end of the lead piece guide 113 in a length corresponding to the retracted length of the lead piece guide 113. Said operation may be repeated until the lead piece guide 113 gets to the last stage in its movable range.

When the lead piece 111 is required to be further projected after the lead piece guide 113 gets to the last stage in its movable range, the knock-button 105 is pushed to further project the lead piece 111 according to the ordinary lead piece stepping operation. In this knocking operation, in the course of further moving forward after releasing the clamp of the lead piece 111, the lead piece chuck 104 abuts the rear end of the friction member 115 to move it forward to the foremost end in its movable range. At this time, the lead piece 111 also moves forward together with the friction member 115 in the same distance, thus the forward end of the lead piece 111 maintained at about the same level as that of the lead piece guide 113. Then, when the knock-button 105 is released, the lead piece chuck 104 retracts, leaving the lead piece 111 and the lead piece guide 113 at the positions, and stops at a position where it is engaged with the chucking ring 107. In this state, repetition of the pushing operation of the knock-button 105 causes the lead piece 111 to move forward by a predetermined length.

As described in detail hereinabove, according to the present invention, there is provided an automatic pencil wherein breaking of the lead piece is certainly eliminated. Further, combination of the above-described two writing conditions causes a lead piece projected by one-time lead piece stepping operation to serve for a period of time far longer than that of the prior art. Further, according to the present invention, when the lead piece guide 113 is in a position where it can move backward, the lead piece 111 can be projected, as required, from the forward end of the lead piece guide 113 merely by pressing the tip end of the lead piece 111 against the paper sheet or the like without the knocking operation. In other words, there is no necessity of the knocking-operation for stepping the lead piece 111 during a period when the lead piece is consumed in a length corresponding to the moving distance of lead piece guide 113, thereby continuing to write for a long period of time without change of the writing condition. Furthermore, in the course of writing, when an excessive pressure (writing pressure) is imposed on the lead piece 111, breaking of the lead piece 111 can be prevented since it resiliently moves backward.

What is claimed is:

1. An automatic pencil comprising:

(a) an outer tube (4 or 101) to be held by a user and having front and rear ends and a first axial opening therein;

(b) a guide means (1 or 102) located at the front end of said outer tube and having a second axial opening in alignment with said first axial opening to form an axial bore (3);

(c) an inner tube (8 or 103) movably located in the axial bore;

(d) a knocking portion means (10 or 105,106) projecting from the rear end of said outer tube and located in said axial bore, said knocking portion means in contact with said inner tube for transmitting a forward knocking force to said inner tube;

(e) a chucking pawl (12) connected to said inner tube for holding a lead piece (15 or 111) axially located in said bore;

(f) a sleeve (11 or 108) located between said outer tube and said inner tube movably along its axis with respect to the outer tube and inner tube;

(g) a first spring (13 or 110) disposed in and engaging said sleeve and said inner tube for urging said sleeve forward with respect to said inner tube;

(h) a chucking ring (14 or 107) encircling said chucking pawl movable with respect to said pawl and in a limited range, said ring abutting the front end of said sleeve, said movement thereby causing said pawl to selectively hold the lead piece in position and permitting release of the lead piece when said inner tube is moved to the position at which said ring reaches the forward end of its movable range;

(i) a second spring (16 or 109) engaging said sleeve and said outer tube for urging said sleeve forward with respect to said outer tube;

(j) a lead piece guide (2,6 or 113,114) having a central bore in which the lead piece is located, said lead piece guide extending from the forward end of said guide means exteriorly of the pencil and selectively movable in a limited range along its axis with respect to said guide means; and (k) a friction member (5 or 115) movable between said lead piece guide and said chucking pawl within said guide means and having a bore within which the lead piece passes with a predetermined friction and a flange portion (7) which engages an inner portion of said guide means to produce a predetermined friction against movement of said friction member with respect to said guide means whereby said lead piece guide retracts as the lead piece wears due to pressure of said lead piece on a writing surface so that the lead piece advances when pressure on the lead piece is released, the advancing being due to said first spring urging said sleeve forward while said lead piece guide remains in a retracted position due to friction between said friction member and said guide means.

2. The automatic pencil as claimed in claim 1, in which said friction member is made of rubber.

3. An automatic pencil comprising:

(a) an outer tube (4 or 101) to be held by a user and having front and rear ends and a first axial opening therein;

(b) a guide means (1 or 102) located at the front end of said outer tube and having a second axial opening in alignment with said first axial opening to form an axial bore (3);

(c) an inner tube (8 or 103) movably located in the axial bore;

(d) a knocking portion means (10 or 105,106) projecting from the rear end of said outer tube and located in said axial bore, said knocking portion means in contact with said inner tube for transmitting a forward knocking force to said inner tube;

(e) a chucking pawl (12) connected to said inner tube for holding a lead piece (15 or 111) axially located in said bore;

(f) a sleeve (11 or 108) located between said outer tube and said inner tube movably along its axis with respect to the outer tube and inner tube;

(g) a first spring (13 or 110) disposed in and engaging said sleeve and said inner tube for urging said sleeve forward with respect to said inner tube;

(h) a chucking ring (14 or 107) encircling said chucking pawl movable with respect to said pawl and in a limited range, said ring abutting the front end of said sleeve, said movement thereby causing said pawl to selectively hold the lead piece in position and permitting release of the lead piece when said inner tube is moved to the position at which said ring reaches the forward end of its movable range;

(i) a second spring (16 or 109) engaging said sleeve and said outer tube for urging said sleeve forward with respect to said outer tube;

(j) a lead piece guide (2,6 or 113,114) having a central bore in which the lead piece is located, said lead piece guide extending from the forward end of said guide means exteriorly of the pencil and selectively movable in a limited range along its axis with respect to said guide means;

(k) a second sleeve (17) having a flange (18) at one end thereof located between said guide means and said sleeve, said flange portion of said friction member engaging said second sleeve for limiting the movement of said friction member between said flange of said second sleeve and said chucking ring; and (l) a friction member (5 or 115) movable between said lead piece guide and said chucking pawl within said guide means and having a bore within which the lead piece passes with a predetermined friction and a flange portion (7) which engages said second sleeve to produce a predetermined friction against movement of said friction member with respect to said second sleeve whereby said lead piece guide retracts as the lead piece wears due to pressure of said lead piece on a writing surface so that the lead piece advances when pressure on the lead piece is released, the advancing being due to said first spring urging said sleeve forward while said lead piece guide means remains in a retracted position due to friction between said friction member and said second sleeve.

4. The automatic pencil as claimed in claim 3, in which said friction member is made of rubber.

* * * * *